United States Patent [19]

Sauger

[11] Patent Number: 4,671,437

[45] Date of Patent: Jun. 9, 1987

[54] DRAWSTRING RESTRINGING SYSTEM

[76] Inventor: Marvin E. Sauger, 7290 Helen, Center Line, Mich. 48015

[21] Appl. No.: 882,397

[22] Filed: Jul. 7, 1986

[51] Int. Cl.[4] ..... D05B 85/00

[52] U.S. Cl. ..... 223/103; 223/102; 223/105; 223/50

[58] Field of Search ..... 223/103, 102, 105, 50

[56] References Cited

U.S. PATENT DOCUMENTS

| | | | |
|---|---|---|---|
| 609,712 | 8/1898 | Thompson | 223/103 |
| 1,217,046 | 2/1917 | Mitchell | 223/103 |
| 2,491,776 | 12/1949 | Skelton | 223/105 X |
| 2,786,619 | 3/1957 | Marion | 223/102 |
| 3,097,474 | 7/1963 | Rohdenburg | 223/102 X |
| 3,473,711 | 10/1969 | Laub | 223/105 |

FOREIGN PATENT DOCUMENTS

| | | | |
|---|---|---|---|
| 491740 | 9/1938 | United Kingdom | 223/105 |

*Primary Examiner*—Harvey C. Hornsby
*Assistant Examiner*—J. L. Olds
*Attorney, Agent, or Firm*—Lyman R. Lyon

[57] ABSTRACT

A drawstring restringing system comprises a notched flexible rod having a flexible end cap for securing a drawstring to the rod to facilitate restringing of the drawstring through a channel in a garment.

1 Claim, 5 Drawing Figures

DRAWSTRING RESTRINGING SYSTEM

BACKGROUND OF THE INVENTION

The drawstring restringing system of the instant invention is an improvement on known cord restringing systems as disclosed in U.S. Pat. No. 299,305, issued May 1884, and, more recently, in U.S. Pat. No. 2,491,776, issued Dec. 20, 1949.

Modern sports apparel, for example, swimsuits, warm-ups, children's clothing, etc., often utilize drawstrings that extend through a channel in the garment for the purpose of tightening the garment about the body. However, accidental stripping of such a drawstring from its channel often presents a reassembly problem. Known restringing devices do not provide for efficient and secure attachment of the drawstring to the restringing device and are often inadequate in guiding the cord through the distances required.

SUMMARY OF THE INVENTION

The aforesaid problems are solved by the restringing device of the present invention. Restringing of a drawstring is accomplished by securing one end thereof to a specially notched semi-rigid stringing rod. A novel bullet-shaped cap of elastomeric material secures the drawstring in the notch in the stringing rod. The stringing rod is of circular cross section and of sufficient length to extend through the garment channel.

DETAILED DESCRIPTION OF THE PREFERRED EMBODIMENT OF THE INVENTION

Figures 1, 2, 3, 4, 5:
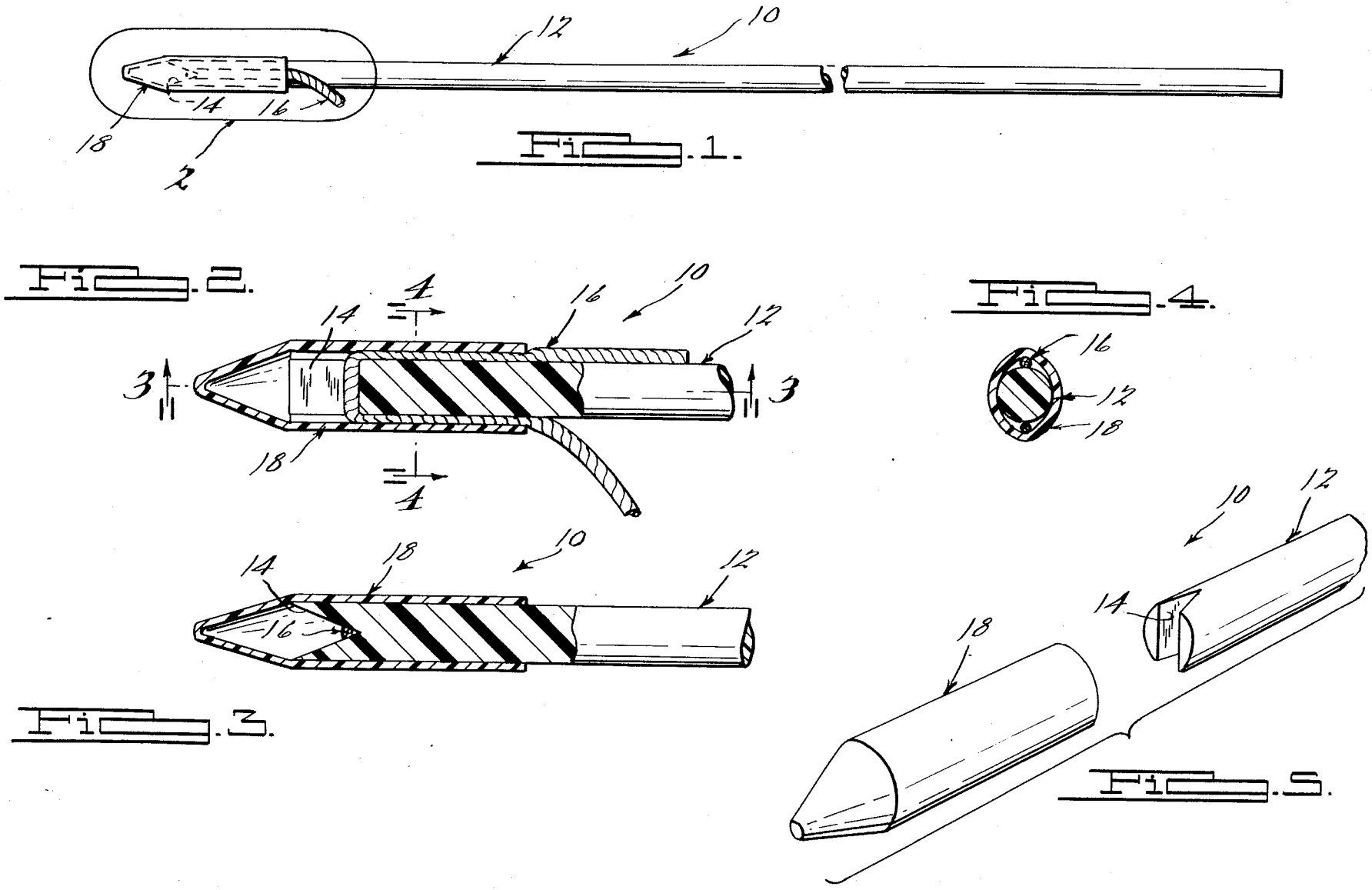
FIG. 1 is a view of a stringing system with a cord secured thereto.
FIG. 2 is an enlarged cross-sectional view taken within the circle "2" of FIG. 1.
FIG. 3 is a cross-sectional view taken along the line 3—3 of FIG. 2.
FIG. 4 is a view taken along the line 4—4 of FIG. 2.
FIG. 5 is a perspective view of the stringing system of FIG. 1.

As seen in the drawing, a stringing system 10, in accordance with a constructed embodiment of the instant invention comprises a solid, flexible, circular stringing rod 12 made from, for example, flexible nylon of 3/16 inch diameter. One end of the rod 12 is provided with a notch 14 for the acceptance of a cord 16. A specially formed bullet tip 18 of resilient or elastomeric material encloses the notch 14 and cord 16 preventing the cord 16 from stripping during stringing.

A drawstring restringing system 10, in accordance with a constructed embodiment of the instant invention, comprises a stringing rod 12 of such a composition, for example, nylon, as to be flexible yet exhibit the structural rigidity necessary for stringing during columnar loading. A rod length of approximately 32 inches is adequate for most applications.

As best seen in FIGS. 2 and 3, the rod 12 has a notch 14 for the acceptance of one end of a drawstring 16. The drawstring 16 is drawn down over the rod 12 to facilitate telescoping of a hollow, elastomeric bullet-shaped tip 18 thereover. The tip 18 is made from relatively soft material, for example, vinyl, so as to accommodate and flex over the drawstring 16. After restringing of the drawstring 16, detachment of the tip 18 from the rod 12 allows for easy removal of the rod 12.

While the preferred embodiment of the invention has been disclosed, it should be appreciated that the invention is susceptible of modification without departing from the scope of the following claims.

I claim:

1. A drawstring restringing system comprising a thin flexible rod having a V-shaped laterally extending notch in one end thereof, and an elastic tip having a bullet-shaped closed end portion and an open end portion for the acceptance of the notched end of said rod, and a drawstring having a first portion extending parallel to said rod on one side thereof, a second portion extending laterally through said notch, and a third portion extending parallel to said rod on the opposite side thereof from said first portion, said tip being sufficiently elastic to accommodate and stretch over the one end of said rod and over the first and third portions of said drawstring so as to retain the second portion thereof in the notch in said rod.

* * * * *